US011554457B2

(12) United States Patent
Spears

(10) Patent No.: US 11,554,457 B2
(45) Date of Patent: Jan. 17, 2023

(54) PLANETARY CONCRETE GRINDER

(71) Applicant: Husqvarna AB, Huskvarna (SE)

(72) Inventor: Grant Spears, Pawnee, OK (US)

(73) Assignee: HUSQVARNA AB, Huskvarna (SE)

( * ) Notice: Subject to any disclaimer, the term of this patent is extended or adjusted under 35 U.S.C. 154(b) by 446 days.

(21) Appl. No.: 16/779,159

(22) Filed: Jan. 31, 2020

(65) Prior Publication Data

US 2021/0237220 A1 Aug. 5, 2021

(51) Int. Cl.

| | |
|---|---|
| ***B24B 7/18*** | (2006.01) |
| ***B24B 23/02*** | (2006.01) |
| ***B24B 41/047*** | (2006.01) |
| ***B24B 47/12*** | (2006.01) |

(52) U.S. Cl.

CPC ..... *B24B 7/186* (2013.01); *B24B 23/02* (2013.01); *B24B 41/047* (2013.01); *B24B 47/12* (2013.01)

(58) Field of Classification Search

CPC ..... B24B 7/186; B24B 23/02; B24B 41/047; B24B 47/12

USPC ..... 451/353; 318/3, 558

See application file for complete search history.

(56) References Cited

U.S. PATENT DOCUMENTS

| | | | | |
|---|---|---|---|---|
| 3,936,212 | A | 2/1976 | Holz, Sr. et al. | |
| 4,155,596 | A | 5/1979 | Brejcha | |
| 4,182,001 | A | 1/1980 | Krause | |
| 4,319,434 | A | 3/1982 | Brejcha | |
| 4,630,214 | A * | 12/1986 | Barney | G05B 19/4166 451/26 |
| 4,709,510 | A | 12/1987 | Giovanni et al. | |
| 5,375,783 | A * | 12/1994 | Gamblin | B02C 17/08 241/175 |
| 5,480,258 | A | 1/1996 | Allen | |
| 7,261,623 | B1 | 8/2007 | Palushi | |
| 7,326,106 | B1 | 2/2008 | Rogers et al. | |
| 7,481,602 | B2 | 1/2009 | Lampley et al. | |
| 7,775,741 | B2 | 8/2010 | Copoulos | |
| 8,715,039 | B2 | 5/2014 | Chen | |
| 9,272,383 | B1 | 3/2016 | Dickson | |
| 9,919,400 | B2 | 3/2018 | Dickson | |
| 10,246,885 | B2 | 4/2019 | Tchakarov | |
| 10,307,880 | B1 | 6/2019 | Richards | |
| 2007/0077873 | A1 | 4/2007 | Vankouwenberg | |
| 2007/0232207 | A1 | 10/2007 | Palushi | |
| 2009/0074511 | A1 | 3/2009 | Anderson | |

(Continued)

FOREIGN PATENT DOCUMENTS

| | | | |
|---|---|---|---|
| DE | 202007010059 | U1 | 10/2007 |
| WO | 2018132598 | A1 | 7/2018 |

OTHER PUBLICATIONS

International Search Report and Written Opinion in the International Application No. PCT/US2020/067337 dated Apr. 19, 2021.

*Primary Examiner* — David Luo
(74) *Attorney, Agent, or Firm* — Burr & Forman, LLP

(57) ABSTRACT

A concrete grinder has a rotating planetary gearbox with counter rotating tooling plates attached. The planetary gearbox is powered directly from a trowel gearbox output shaft, which is connected to a center bore of the planetary gearbox. As the planetary gearbox rotates, tooling shafts are forced to counter rotate because the input shaft of the planetary gearbox is connected to a fixed pulley or sprocket. The planetary gearbox is sealed to keep water, dust or slurry from entering.

15 Claims, 7 Drawing Sheets

(56) References Cited

U.S. PATENT DOCUMENTS

| | | | |
|---|---|---|---|
| 2009/0190999 | A1 | 7/2009 | Copoulos |
| 2010/0203813 | A1 | 8/2010 | Ward et al. |
| 2018/0193977 | A1 | 7/2018 | Clay |

* cited by examiner

PLANETARY CONCRETE GRINDER

FIELD OF THE DISCLOSURE

Aspects of the present disclosure relate generally to concrete grinders and, more particularly, to planetary concrete grinders.

SUMMARY

According to an aspect of the present disclosure, a planetary concrete grinder includes a body. At least one planetary gearbox is rotatably secured to the body, each planetary gearbox having a center bore configured to receive a drive shaft. A bull gear is rotationally fixed to the body. A plurality of tooling assemblies are attached to the planetary gearbox. Each tooling assembly includes a shaft, and a first sprocket along a length of the shaft. A driven tooling assembly of the plurality of tooling assemblies further includes a second sprocket along the length of the shaft. A first driver couples rotation of the bull gear with rotation of the second sprocket of the driven tooling assembly. A second driver engages the first sprocket of each of the tooling assemblies. Each planetary gearbox includes a stop bolt, secured within the center bore and below and abutting the drive shaft, sealing the planetary gearbox.

In some embodiments, the driven tooling assembly further comprises a bearing support configured to be secured to a lid portion of the at least one respective planetary gearbox.

In some embodiments, the driven tooling assembly further comprises an upper shaft end bearing secured to the bearing support, the upper shaft end bearing being configured to receive the shaft of the driven tooling assembly and to seal the planetary gearbox.

In some embodiments, each tooling assembly further comprises a coupler secured to the shaft and configured to support a proportionate vertical load.

In some embodiments, each of the plurality of tooling assemblies further comprises a coupler secured to the shaft at a lower end of the shaft and configured to support a proportionate vertical load.

In some embodiments, the shaft of each tooling assembly is constructed from a high tensile strength material.

In some embodiments, each planetary gearbox further comprises a gearbox body including a plurality of arms, each tooling assembly being secured at a distal end of a respective one of the arms.

In some embodiments, the planetary concrete grinder of further comprises a receiver at the end of each of the arms configured to receive the shaft of a respective tooling assembly.

In some embodiments, each tooling assembly further comprises at least one bearing along the length of the shaft; and a seal engaging a bottom surface of the at least one bearing.

In some embodiments, the at least one bearing and the seal are secured within one of the receivers that is configured as a sleeve.

In some embodiments, the at least one bearing is two bearings received in the sleeve.

In some embodiments, each planetary gearbox further comprises at least one tensioner engaging one of the first driver and the second driver.

In some embodiments, each tooling assembly supports at least one tool head.

In some embodiments, at least one of the tool heads comprises diamond abrasive.

In some embodiments, each planetary gearbox is positioned in a drum-shaped housing.

In some embodiments, the stop bolt seals a bottom portion of the housing.

According to another aspect of the present disclosure, a planetary concrete grinder comprises a body. At least one planetary gearbox is rotatably secured to the body, each planetary gearbox having a center bore configured to receive a drive shaft. A bull gear is rotationally fixed to the body. A plurality of tooling assemblies attached to the planetary gearbox. Each tooling assembly includes a shaft, a first sprocket along a length of the shaft, a bearing along the length of the shaft, and a seal engaging a bottom surface of the bearing. A first tooling assembly of the plurality of tooling assemblies further includes a second sprocket at an upper end of the shaft of the first tooling assembly. A first chain couples rotation of the bull gear with rotation of the second sprocket of the first tooling assembly, and a second chain engages the first sprocket of each of the tooling assemblies.

According to another aspect of the present disclosure, a planetary concrete grinder comprises a body. At least one planetary gearbox rotatably secured to the body, each planetary gearbox having a center bore configured to receive a drive shaft. Each planetary gearbox has at least one lid portion at an upper end of the planetary gearbox. A bull gear is rotationally fixed to the body. A plurality of tooling assemblies attached to the planetary gearbox. Each tooling assembly includes a shaft, and a first sprocket along a length of the shaft. A first tooling assembly of the plurality of tooling assemblies further includes a second sprocket at an upper end of the shaft of the first tooling assembly, a bearing support configured to be secured to each one lid portion at the upper end of the planetary gearbox, and an upper shaft end bearing secured to the bearing support. The upper shaft end bearing is configured to receive the shaft of the first tooling assembly. A first chain couples rotation of the bull gear with rotation of the second sprocket of the first tooling assembly, and a second chain engages the first sprocket of each of the tooling assemblies.

In some embodiments, the at least one lid portion and the bearing support forms a continuous upper surface at an upper end of the planetary gearbox.

According to another aspect of the present disclosure, a planetary concrete grinder comprises a body. At least one planetary gearbox is rotatably secured to the body, each planetary gearbox having a center bore configured to receive a drive shaft. A bull gear is rotationally fixed to the body. A plurality of tooling assemblies is attached to the planetary gearbox. Each tooling assembly includes a shaft, a first sprocket along a length of the shaft, a coupler secured to the shaft at a lower end of the shaft, and a tooling plate secured to the coupler. A first tooling assembly of the plurality of tooling assemblies further including a second sprocket at an upper end of the shaft of the first tooling assembly. A first chain couples rotation of the bull gear with rotation of the second sprocket of the first tooling assembly, and a second chain engages the first sprocket of each of the tooling assemblies.

DESCRIPTION OF THE DRAWINGS

The accompanying drawings are not intended to be drawn to scale. For purposes of clarity, not every component may be labeled in the drawings.

In the drawings.

DETAILED DESCRIPTION

Figure 1:
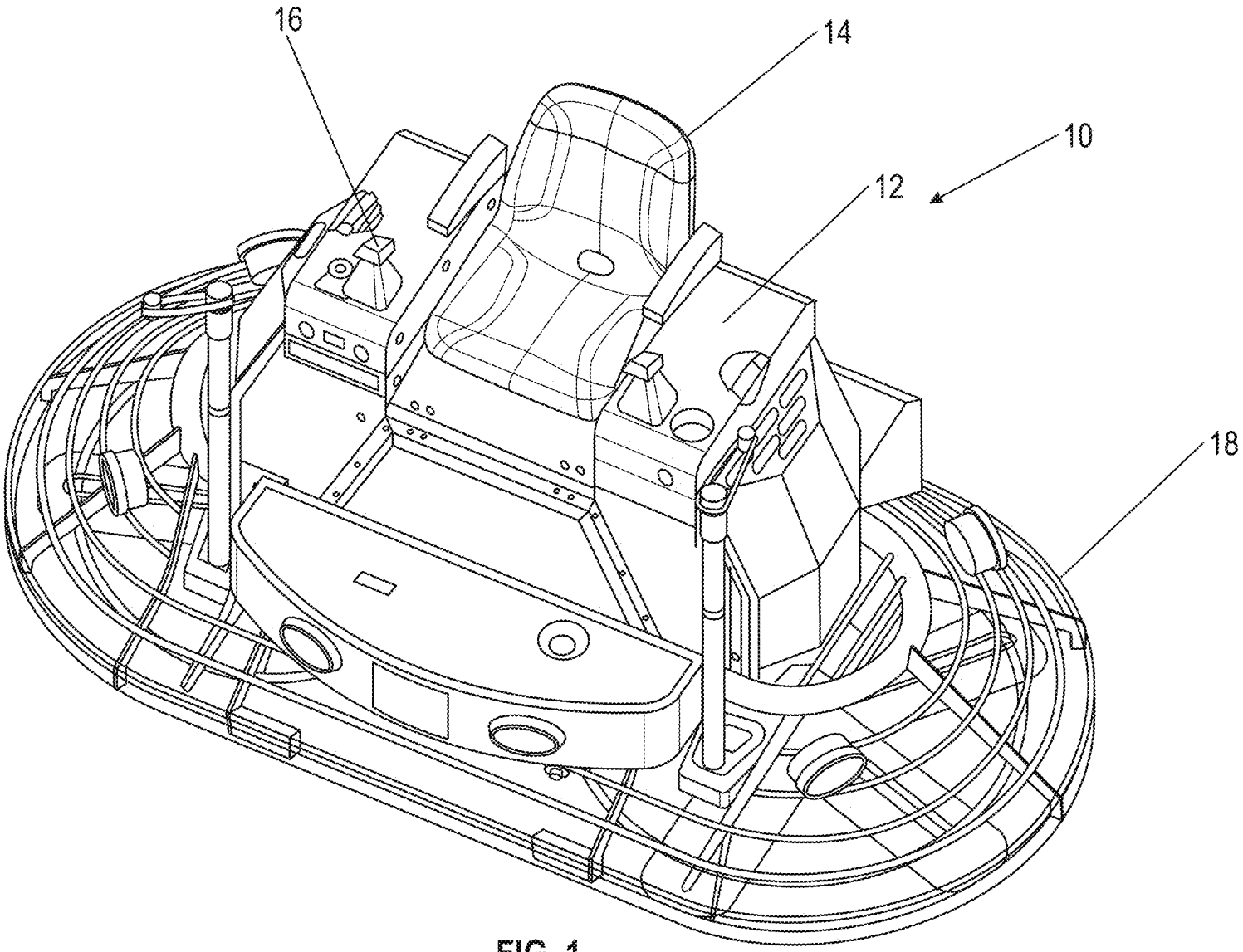
FIG. 1 illustrates a perspective view of an embodiment of a planetary concrete grinding device according to the present disclosure.

Planetary concrete grinders are used for grinding and polishing floors. Conventional grinders can be used to grind or polish a variety of floor surfaces, but are primarily used on concrete. The machines are used to level surfaces, grind down concrete, remove coatings, and polish substrates. Depending on the type of tooling used, planetary concrete grinders can be used in a variety of applications. Grinders typically use one or more rotating disks supporting abrasive pads that contact the floor. Grinders are available in walk-behind and ride-on configurations.

Ride-on concrete grinders typically feature heavy-duty gear constructions and are large and heavy machines. As a result, in operation, the rotating tools used in these units in contact with floors release dust and solid particles and, potentially, create slurries when used in wet applications.

These conditions expose a planetary concrete grinder to stirred-up particles that can include liquids, dust, slurry, and other matter. The stirred-up particles could interfere with operation of internal components of the planetary concrete grinder, such as chains and sprockets and other components. Sufficiently large particles could bind a chain within the planetary concrete grinder. Various particles may also corrode components of the planetary concrete grinder over time. The present disclosure provides an improved planetary concrete grinder that is sealed. It has been recognized that sealing the planetary gearbox housing will increase the service life of the planetary gearbox. In some embodiments, the present disclosure provides a planetary gearbox housing that is sealed by various components, such as a stop bolt assembly and an upper bearing support.

Sealing the planetary gearbox also has the advantage of retaining desirable fluids, such as oil, within the planetary gearbox. Various components within the planetary gearbox may be oiled. For example, chains, sprockets, and other components may be oiled to improve their service life.

Planetary concrete grinders can be quite heavy. In some embodiments, a planetary concrete grinder has an operating weight of up to 3,000 pounds. In some embodiments, a planetary concrete grinder has an operating weight of up to 2,000 pounds. In some embodiments, a planetary concrete grinder has an operating weight of about 1,500 pounds. During operation of the planetary concrete grinder, this weight is supported by the parts of the planetary concrete grinder that are in contact with the floor. Typically, the only parts of the planetary concrete grinder that is in contact with the floor during operation are the tool heads, such as abrasive pads. Forces to the body of the planetary concrete grinder are transmitted to the pads. In the case of a ride-on planetary concrete grinder, the pads support the weight of the planetary concrete grinder itself as well as the weight of the human operating the planetary concrete grinder.

In addition to the weight of the grinder and the weight of the human, the pads support dynamic loads during operation. Shocks and impulse loads applied to the concrete grinder are transmitted to the pads. Vibrational loads due to operation of the trowel engine of the planetary grinder are also transmitted to the pads.

Increasing the number of pads generally decreases the magnitude of the load transferred to a single pad. Decreasing the loads applied to a single pad can increase the service life of the structures supporting those pads. The present disclosure includes additional features to improve the service life of the planetary grinder. The present disclosure also provides a planetary gearbox that has better load distribution than prior art planetary concrete grinders. The present disclosure provides a planetary gearbox that includes tooling assemblies that use couplers that are better suited to distributing vertical loads to the tooling pads on lower surfaces of the tooling assemblies.

The present disclosure relates generally to devices and methods for preparing concrete surfaces. In some embodiments, devices and methods of the present disclosure are useful for preparing concrete surfaces prior to the application of surface coatings. In some embodiments, devices and methods of the present disclosure are useful for polishing concrete for staining and decorative use.

Devices and methods of the present disclosure include improvements on known technology. Devices and methods of the present disclosure provide improvements relating to strength, durability, load response, and maintenance of planetary concrete grinding equipment, among other advantages. The features described herein give the devices and methods of the present disclosure advantages over known planetary grinders.

According to an aspect of the present disclosure, a planetary concrete grinder includes a multiple-headed planetary machine. The body of the planetary concrete grinder may enclose various structures of the planetary concrete grinder. In some embodiments, an engine powers at least one planetary gearbox. In some embodiments, the engine is a trowel engine. Each planetary gearbox supports a plurality of tooling assemblies. Each tooling assembly has a shaft and supports at least one tool at a lower end of the shaft. The planetary gearbox rotates in a clockwise or counterclockwise direction about a central axis of the planetary gearbox and the shaft of each tooling assembly rotates in a clockwise or counterclockwise direction about an axis of the shaft of the respective tooling assembly. In some embodiments, the planetary gearbox rotates in a first direction about a central axis of the planetary gearbox and the shaft of each tooling assembly rotates in a second direction about an axis of the shaft of the respective tooling assembly. In some embodiments, the second direction is opposite to the first direction. In some embodiments, the second direction is the same as the first direction.

The planetary concrete grinder (the device) has a body that may be made of one or more materials that are sufficiently rigid and sufficiently durable for use in typical operating environments. In some embodiments, the body of the planetary concrete grinder includes a housing that at least partially extends around various components of the device. In some embodiments, the body at least partially extends around an engine of the planetary concrete grinder. In some embodiments, additional structures may be used to at least partially extend around other components of the planetary concrete grinder. In some embodiments, a skirt depends from the body and encloses one or more planetary gearboxes of the planetary concrete grinder.

The planetary concrete grinder is a movable device. In some embodiments, the planetary concrete grinder is a ride-on device. In some embodiments, the ride-on device includes a seat that is mounted on the body of the device.

The planetary concrete grinder may include at least one planetary gearbox. The number of planetary gearboxes may be selected based on the desired working footprint of the planetary concrete grinder. In some embodiments, the planetary concrete grinder includes between 1 and 4 planetary gearboxes. In some embodiments, the planetary concrete grinder includes two planetary gearboxes. In some embodiments, the planetary gearboxes are arranged in a pattern. In some embodiments, the planetary gearboxes are arranged in an array.

Each planetary gearbox is rotatably secured to the body of the planetary concrete grinder, so the respective planetary gearbox can rotate with respect to the body of the planetary concrete grinder.

In some embodiments, each planetary gearbox is positioned in a planetary gearbox housing. The planetary gearbox housing may be configured to protect one or more components within the planetary gearbox from foreign objects, such as solids or liquids. In some embodiments, at least one planetary gearbox is sealed with respect to solids and/or liquids. In some embodiments, at least one planetary gearbox is sealed to keep water, dust, or slurry from entering the planetary gearbox housing and oil from escaping the planetary gearbox housing.

In some embodiments, the planetary gearbox housing includes at least one wall section. In some embodiments, one or more wall sections of the planetary gearbox housing include a lid, a base, and/or a drum side wall. In some embodiments, the planetary gearbox housing includes a lid, a bottom wall, and a drum side wall. In some embodiments, the lid, the bottom wall, and the drum side wall are separate pieces that are joined together. The lid, the bottom wall, and the drum side wall may each be made of one or more pieces. In some embodiments, the lid includes a first lid portion and a second lid portion.

In some embodiments, the planetary gearbox housing is drum-shaped.

The planetary gearbox housing may be made of any material having sufficient rigidity and durability for protecting components of the planetary gearbox. In some embodiments, the planetary gearbox housing is made of metal. In some embodiments, the lid, the bottom wall, and the drum side wall are made of metal.

In some embodiments, a joint is formed between at least two of the wall sections of the planetary gearbox housing. In some embodiments, a joint is formed between at least two of a first lid portion, a second lid portion, the bottom wall, and the drum side wall.

In some embodiments, a material can be placed in a joint between at least two wall sections to improve the seal of the joint. The material placed in the joint(s) may be selected based on the device operating parameters, such as temperature, humidity, and other parameters. In some embodiments, silicone can be used in a joint between at least two wall sections. In some embodiments, silicone can be used in a joint between the first lid portion, the second lid portion, the bottom wall, and/or the drum side wall. In some embodiments, a bead of silicone is placed along the entire joint between the lid, the bottom wall, and/or the drum side wall.

The planetary gearbox housing is rotated during operation. The planetary gearbox may be rotated by an output shaft of an engine of the device. In some embodiments, the lid of the planetary gearbox housing includes a hole that allows a shaft of the engine of the device to be received in a center bore defined in the planetary gearbox. In some embodiments, the center bore of the planetary gearbox is fixed to the planetary gearbox housing so that rotation of the center bore directly results in rotation of the planetary gearbox housing.

A drive shaft of the engine engages the center bore to transfer rotation of the shaft to the center bore, thereby rotating the planetary gearbox housing about the axis of the center bore. In some embodiments, the shaft of the engine engages the center bore via a frictional engagement. In some embodiments, the shaft of the engine is rotationally locked to the center bore. For example, the shaft of the engine may be rotationally secured to the center bore by a keyed engagement. In some embodiments, a driving chain links an output shaft of the engine to the center bore of the planetary gearbox.

In some embodiments, the drive shaft of the engine is a shaft of an engine. In some embodiments, the drive shaft of the engine is a shaft of a gearbox that is coupled to an engine shaft.

To support the drive shaft and to seal a bottom portion of the planetary gearbox housing, a stop bolt assembly is provided beneath the center bore to support the drive shaft. In some embodiments, the stop bolt assembly at least partially extends into the lower end of the center bore. The dimensions and materials of the stop bolt assembly may be selected such that the stop bolt assembly is sufficiently rigid to support the weight of the drive shaft on an upper end of the stop bolt assembly. The stop bolt assembly is configured to allow the shaft of the engine to rest on the stop bolt assembly while the device is being operated and also to at least partially seal the center bore of the planetary gearbox. In some embodiments, the stop bolt assembly seals the center bore of the planetary gearbox.

In some embodiments, the stop bolt is below and abutting the drive shaft, and the stop bolt seals the hole, to help seal the planetary gearbox housing. For example, in some embodiments, the stop bolt extends through a hole in the bottom wall of the planetary gearbox housing and is secured to the bottom wall so that the stop bolt extends within the center bore.

The stop bolt assembly is secured to the planetary gearbox housing. In some embodiments, the stop bolt assembly is secured to the bottom wall of the planetary gearbox housing. In some embodiments, the stop bolt assembly includes a threaded stop bolt that has a first nut and a second nut each threadedly engaging the threaded stop bolt. In some embodiments, the stop bolt extends through a hole in the bottom wall of the planetary gearbox housing. The first nut may be tightened against a lower surface of the bottom wall of the planetary gearbox housing and the second nut may be tightened against an upper surface of the bottom wall of the planetary gearbox housing to secure the stop bolt to the bottom wall of the planetary gearbox housing. An upper end of the stop bolt extends towards the lower end of the center bore of the planetary gearbox housing. In some embodiments, the upper end of the stop bolt extends into the center bore. The upper end of the stop bolt provides a surface on which the shaft of the engine may be supported. The stop bolt assembly transmits the vertical load on the drive shaft, which may be from the weight of the engine and/or other components, to the planetary gearbox housing.

In some embodiments, a device of the present disclosure includes two or more planetary gearboxes. Rotation of the planetary devices may be controlled by a user or a controller. In some embodiments, each planetary gearbox is configured to be rotated by an engine of the device. In some embodiments, each planetary gearbox is configured to be rotated by the engine of the device in the same direction as the other planetary gearboxes. In some embodiments, each planetary gearbox is configured to be rotated by the engine of the device in an opposite direction relative to at least one of the other planetary gearboxes. This opposite rotation of the gearboxes increases the stability of the planetary concrete grinder. In some embodiments, the device includes two planetary gearboxes that are rotated in opposite directions during operation.

Each planetary gearbox supports a plurality of tooling assemblies. A planetary gearbox internal body structure (a gearbox body) may extend radially from a center portion of the gearbox to support the plurality of tooling assemblies. The internal body structure is configured to rigidly support each tooling assembly and to withstand loads during operation, without adding too much weight to the device. In some embodiments, the internal body structure includes arms that extend radially from a center portion of the planetary gearbox, and each arm supports a respective one of the tooling assemblies. In some embodiments, each arm has a receiver to receive a shaft of a tooling assembly. In some embodiments, the receiver is a sleeve. In some embodiments, the sleeve is defined as a hole towards a distal end of the respective arm. In some embodiments, the sleeve is dimensioned and configured to receive bearings and/or other components that receive a shaft of a respective tooling assembly. In some embodiments, the planetary gearbox includes other structures to support the tooling assemblies.

The tooling assemblies may be arranged in a pattern within the planetary gearbox. In some embodiments, the pattern is a circular pattern. In some embodiments, the tooling assemblies are arranged in a circular pattern and each tooling assembly is equidistant from adjacent tooling assemblies in the pattern.

A planetary gearbox housing can support a plurality of tooling assemblies. Increasing the number of tooling assemblies increases the number of passes that the tools make over a surface. However, increasing the number of tooling assemblies also increases risk of failure of the device and increases the number of parts that must be maintained. In some embodiments, the number of tooling assemblies supported by each planetary gearbox may be in the range of two to ten. In some embodiments, the number of tooling assemblies supported by each planetary gearbox may be in the range of three to eight. In some embodiments, the number of tooling assemblies supported by each planetary gearbox may be in the range of four to six. In some embodiments, the number of tooling assemblies supported by a planetary gearbox is five. In some embodiments, the number of tooling assemblies supported by a planetary gearbox is four.

Each tooling assembly is configured to carry one or more tool heads for processing a surface. In some embodiments, each tooling assembly is configured to carry one or more tool heads for processing a concrete surface.

In some embodiments, each tool head is secured to a surface of the tooling assembly such that a user can easily replace the tool head but the tool head will remain attached to the tooling assembly during normal operation of the device. In some embodiments, at least one tool head is secured to a surface of the tooling assembly via at least one of a magnetic fastener, a screw, a hook and loop fastener, and/or another fastener. In some embodiments at least one tool head is secured by a hook and loop fastener to a metal backing, and the metal backing is secured to the tooling assembly by a magnet in the backing and/or a magnet in the tooling assembly.

Each tooling assembly is secured to the planetary gearbox housing such that the tooling assembly rotates with the planetary gearbox housing about the center bore of the planetary gearbox housing.

In some embodiments, each tooling assembly can further rotate about an axis of the tooling assembly. In some embodiments, each tooling assembly has a shaft that extends along an axis about which the tooling assembly rotates.

In some embodiments, the shaft extends from a lower end of the shaft to an upper end of the shaft. In some embodiments, the shaft includes a step to the lower end of the shaft. The step in the shaft creates a positive stop for the shaft without using snap rings.

The material of the shaft may be selected to endure loads experienced during operation of the device. In some embodiments, at least one tooling assembly includes a shaft made a material that allows the shaft to see a spike in load without failure of the shaft. In some embodiments, at least one shaft is made of metal. In some embodiments, at least one shaft is made of steel. In some embodiments, at least one shaft is made of a high tensile strength material. In some embodiments, the high tensile strength material has a tensile strength of at least 100,000 pounds per square inch (psi). In some embodiments, the high tensile strength material has a tensile strength of at least 110,000 psi. In some embodiments, the high tensile strength material has a tensile strength of at least 115,000 psi. In some embodiments, the high tensile strength material has a tensile strength of 115,000 psi. For example, in some embodiments, at least one shaft is made of a high tensile strength steel rod, such as 1144 STRESSPROOF® steel (available from Niagara Lasalle).

The lower end of the shaft is secured to a tooling plate to which at least one tool head is secured. A coupler may be positioned at the lower end of the shaft to couple the shaft to the tooling plate. In some embodiments, the coupler is configured to support a proportionate vertical load of the planetary grinder. Vertical loads of the planetary grinder are divided proportionally among the tooling assemblies and each coupler is configured to carry a portion of the vertical load of the planetary grinder. The coupler may be any coupler capable of handling the loads experienced during operation of the device. For example, the coupler may be a coupler capable of handling the vertical loads experienced by the shaft of the tooling assembly. In some embodiments, a coupler includes a coupler plate welded to the coupler that allows the coupler to be bolted to the tooling plate. In some embodiments, at least one coupler is a coupler that can be used in automotive drivelines. In some embodiments, the coupler includes sleeves to hold the weight of the device. In some embodiments, the sleeves are made of metal. In some embodiments, the sleeves are made of steel.

At least one lower bearing is provided along the length of the shaft of each tooling assembly to secure the shaft to the planetary gearbox housing. Each lower bearing allows rotation of the respective shaft about an axis of the shaft with respect to the planetary gearbox housing.

The lower bearings may be sealed to protect the internal components of the lower bearings and to extend the service life of the lower bearings. In some embodiments, at least one annular seal engages at least one of the lower bearings. In some embodiments, at least one v-lip seal engages at least one of the lower bearings. In some embodiments, a v-lip seal engages a lower surface of the lower-most lower bearing along the shaft. In some embodiments, a plurality of v-lip seals are provided, and each v-lip seal engages a surface of a respective lower bearing along the shaft.

In some embodiments, there are at least two lower bearings received in the sleeve for supporting a shaft of a tooling assembly. In such embodiments, two v-lip seals may be positioned within the sleeve and at opposite ends of the sleeve, so that a first one of the v-lip seals forms a seal at a lower end of the sleeve and a second one of the v-lip seals forms a seal at an upper end of the sleeve. The two v-lip seals prevent particles from getting into the sleeve. This extends the service life of the two lower bearings.

One of the tooling assemblies is driven by a bull gear that is secured to the body of the device. In some embodiments, this driven tooling assembly includes a shaft that extends through the lid of the planetary gearbox housing so that the upper end of the shaft may be driven, as discussed in more detail below. The driving loads on the shaft can cause the shaft to bend, which can damage the lid and cause leaks in the lid. An upper bearing (an upper shaft end bearing) is provided to help seal the planetary gearbox housing while giving extra support to the shaft. The upper bearing receives the upper end of the driven shaft and is secured to the planetary gearbox housing. In some embodiments, the upper bearing minimizes bending of the driven shaft. In some embodiments, this upper bearing is in an aluminum housing to allow the bearing to slip in the housing during failure.

To support this upper bearing on the planetary gearbox housing, an upper bearing support is provided. The upper bearing support may include a surface to which the upper bearing may be secured. The upper bearing support is configured to allow the lid of the planetary gearbox housing to be removed while not disturbing any of the other components within the planetary gearbox housing. In some embodiments, the upper bearing support is configured to be fastened to a lid portion of the respective planetary gearbox. In some embodiments, the upper bearing support is configured to be fastened to each section of the lid. In some embodiments, silicone may be used at the joint between each lid section and the upper bearing support. The upper bearing support may be in the form of a plate.

Each tooling assembly may include one or more tool heads secured to a lower surface of the tooling assembly. The one or more tool heads can be secured by any known means. For example, the one or more tool heads can be secured using a mechanical fastener, a chemical fastener, a magnetic fastener, or another fastener. Each tool head can be used for preparing a surface over which the device is operated, such as a cured concrete surface. In some embodiments, each tool is a grinding tool for grinding a concrete surface, a polishing tool for polishing a concrete surface, or another tool for processing a concrete surface. In some embodiments, at least one of the tools is a pad. In some embodiments, at least one of the tools is a disc pad. In some embodiments, at least one of the tools comprises a diamond abrasive. In some embodiments, at least one of the tools comprises a silicon carbide abrasive.

As mentioned above, the tooling assemblies rotate about a central axis of the planetary gearbox, and each tooling assembly rotates in an opposite direction about the axis of the shaft of the respective tooling assembly. Advantages of this counterrotation include a more even grinding of a floor and less abrupt transitions at the edges of the paths of the of the tool heads. If the tool heads simply followed the rotational path of the planetary gearbox housing, the tool heads may leave abrupt grooves in circular patterns as the tool heads are moved over a surface. By rotating with the planetary gearbox housing as well as locally about the shaft of the tooling assembly, the tool heads grind the floor more evenly, leaving less abrupt variations in the extent to which the pads grind the floor.

The rotation of the planetary gearbox and the counterrotation of the tooling assemblies may be effected by various one or more drivers. In some embodiments, the drivers include chains and/or belts. In some embodiments, the drivers include any other conventional toothed or spoked item for mating with a sprocket. Within the planetary gearbox there are two chains or belts. The two chains may include an upper chain and a lower chain.

To keep the drivers in engagement with driving surfaces and driven surfaces, at least one tensioner may be provided to engage a driver. In some embodiments, a first tensioner engages a first chain to keep the first chain in engagement with a first set of sprockets. In some embodiments, a second tensioner engages a second chain to keep the second chain in engagement with a second set of sprockets.

Counterrotation of the tooling assemblies relative to the planetary gearbox housing may be achieved by linking the rotation of at least one of the linking assemblies to the rotation of the body of the device relative to the planetary gearbox housing, and simultaneously linking the rotation of each linking assembly to the rotation of the other linking assemblies.

In some embodiments, the upper chain links rotation of the body of the device and shaft of the driven tooling assembly. In some embodiments, the upper chain links rotation of a bull gear secured to the body of the device and a sprocket secured along the length of the shaft of the driven tooling assembly. In some embodiments, the upper chain links rotation of a bull gear secured to the body of the device and a sprocket secured to the upper end of the shaft of the driven tooling assembly. To reduce failure of the upper chain some embodiments include a first tensioning sprocket that engages the upper chain. In some embodiments, the first tensioning sprocket is secured to the planetary gearbox housing. In some embodiments, the first tensioning sprocket is secured to the upper bearing support.

In some embodiments, the lower chain links rotation of the shafts of the tooling assemblies. In some embodiments, the lower chain engages each tooling assembly via a sprocket that is fixed to the respective tooling assembly along the length of the shaft of the tooling assembly. To reduce failure of the lower chain some embodiments include a second tensioning sprocket that engages the lower chain. In some embodiments, the second tensioning sprocket is secured within the planetary gearbox housing. In some embodiments, the second tensioning sprocket is secured to the planetary gearbox housing. In some embodiments, the second tensioning sprocket is secured to an internal body structure of the planetary gearbox housing. In some embodiments, the second tensioning sprocket is secured to one of the arms within the planetary gearbox housing.

During operation of the device, each planetary gearbox housing rotates relative to the body of the device. However, the upper chain imparts a counterrotation to the driven linking assembly relative to the planetary gearbox housing because the rotation of the device body and the rotation of the driven tooling assembly are linked. As the driven tooling assembly is rotated, that rotation is transmitted to the other tooling assemblies via the lower chain.

Although the above description relates to an upper chain and a lower chain, the physical relationship of the chains could be reversed in some embodiments. Although the above description relates to chains, other drivers are used in place of the chains in some embodiments.

Example Embodiment

FIGS. 1-7 show an example of a planetary concrete grinder according to the present disclosure.

FIG. 1 shows a ride-on planetary concrete grinder 10. The grinder 10 includes a body 12 that has an upper surface that supports a seat 14 for a user. The user may operate the grinder 10 via the controls 16. The body 12 encloses an engine for powering planetary gearboxes that are at the lower end of the grinder 10. At a lower end of the body 12 is a skirt frame 18 that is configured to support a skirt. The skirt frame 18 extends around a perimeter of the grinder 10 and extends around components of the grinder 10, such as the planetary gearboxes.

Figure 2:
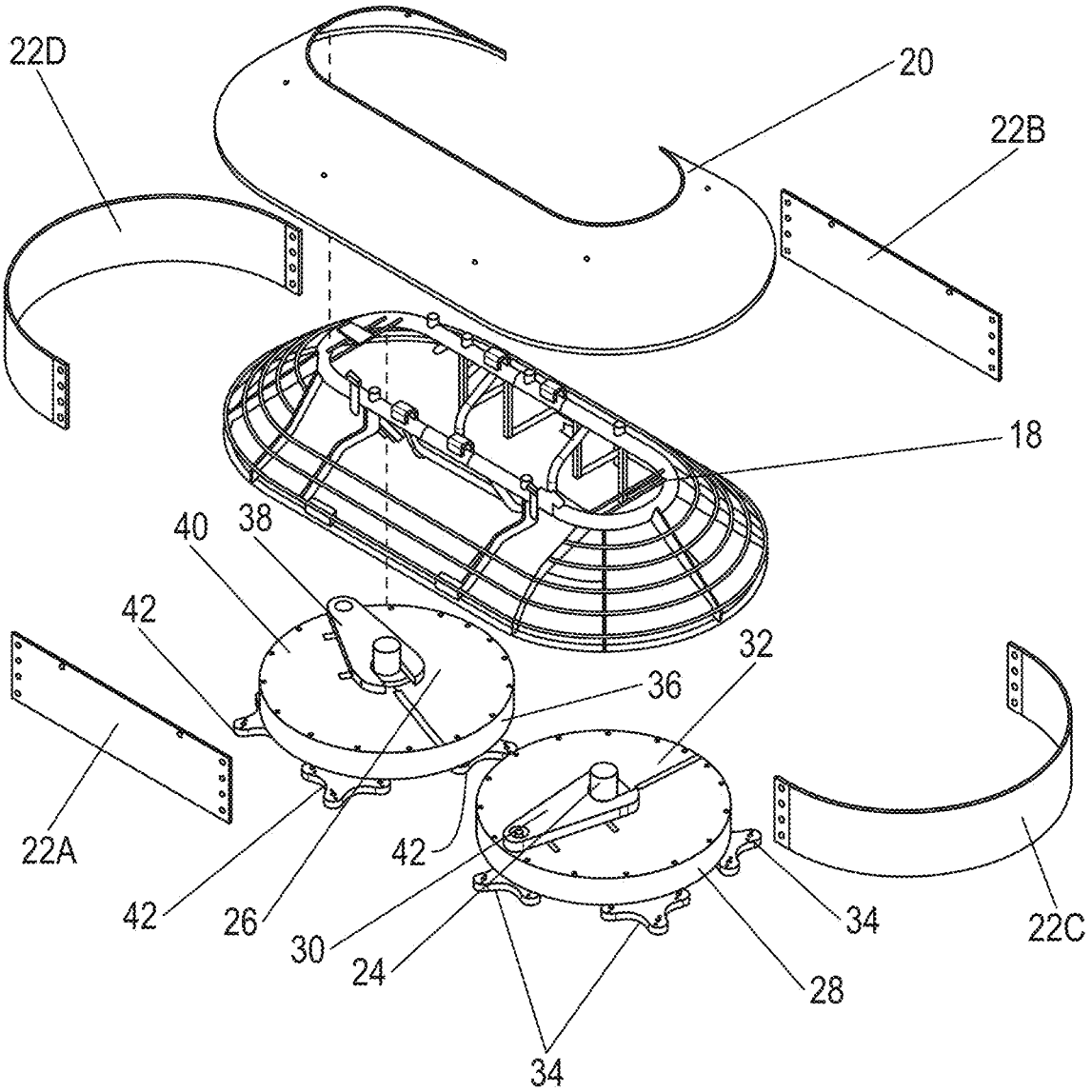
FIG. 2 illustrates an exploded perspective view of a portion thereof.

FIG. 2 is an exploded view of the lower portion of the grinder 10. A skirt is formed of various sections. The skirt includes an upper portion 20, a front panel 22A, a rear panel 22B, a first end panel 22C, and a second end panel 22D. The skirt may be made of a flexible material that is configured to limit matter such as air, dust, debris, and/or liquid from passing through the skirt. In some embodiments the skirt is made of canvas and/or rubber. In some embodiments, the upper portion 20 is made of different material from the front, rear, and end panels 22A, 22B, 22C, 22D. In the example embodiment, the upper portion 20 is made of canvas. In the example embodiment, the front panel 22A, the rear panel 22B, the first end panel 22C, and the second end panel 22D are made of rubber.

FIG. 2 shows how the skirt frame 18 and the skirt are dimensioned and configured to provide an upper shroud around a first planetary gearbox 24 and a second planetary gearbox 26 of the grinder 10. In particular, the skirt frame 18 has rounded ends to follow the outer contour of the first planetary gearbox 24 and second planetary gearbox 26, which sit side-by-side within the skirt frame 18.

The first planetary gearbox 24 includes a first planetary gearbox housing 28 that is substantially cylindrical. An upper chain guard 30 is secured to the planetary gearbox housing 28 above the lid 32 of the first planetary gearbox housing 28. The upper chain guard 30 protects an upper chain of the planetary gearbox. Five tooling assemblies 34 extend downwardly from a lower surface of the first planetary gearbox housing 28. Each tooling assembly carries four tool heads.

The second planetary gearbox 26 includes a first planetary gearbox housing 36 that is substantially cylindrical. An upper chain guard 38 is secured to the planetary gearbox housing 36 above the lid 40 of the second planetary gearbox housing 36. The upper chain guard 38 protects an upper chain of the planetary gearbox. Five tooling assemblies 42 extend downwardly from a lower surface of the second planetary gearbox housing 36. Each tooling assembly carries four tool heads.

Figure 3:
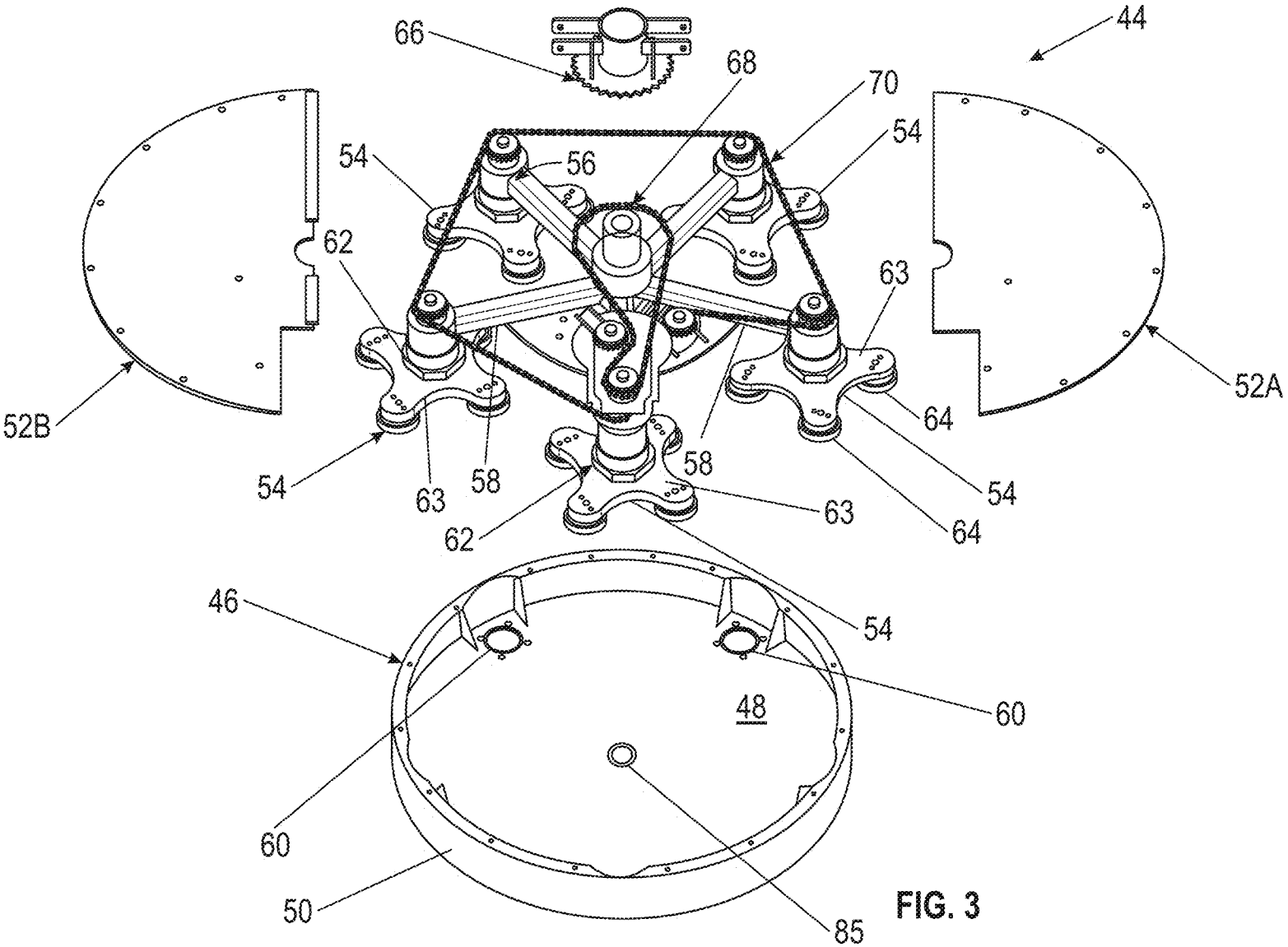
FIG. 3 illustrates an exploded perspective view of a planetary gearbox housing thereof.

FIG. 3 is an exploded view of an exemplary planetary gearbox 44, which is similar to the planetary gearboxes 24, 26 of FIG. 2.

The planetary gearbox, shown generally at 44, includes a drum (a planetary gearbox housing) 46 having a bottom wall 48, a side wall 50 that is substantially cylindrical, and a lid. The lid includes a first lid section 52A and a second lid section 52B that can be fastened to the side wall 50. An upper chain guard, which is similar to the upper chain guard of FIG. 2, may be secured to the planetary gearbox housing above the lid of the planetary gearbox housing.

Five tooling assemblies 54 are supported by an internal gearbox body 56 that has five ribs 58 that extend radially outwardly from a center of the planetary gearbox. Each tooling assembly 54 is at the radially outward end of a respective one of the ribs 58.

The tooling assemblies 54 extend downwardly from a lower surface of the first planetary gearbox housing. In particular, each tooling assembly 54 extends through a respective hole 60 defined in the bottom wall 48 of the planetary gearbox housing.

Each tooling assembly 54 has a coupler 62 that couples the shaft of the tooling assembly to a tooling plate 63. Each tooling plate 63 carries four tool heads 64.

The counterrotation of the tooling assemblies relative to the drum of the planetary gearbox is caused by the operation of two chains. An upper chain 68 links a bull gear 66 to a sprocket on a driven tooling assembly. A lower chain 70 links the rotation of the tooling assemblies 54 to be in the same direction as each other.

Figure 4:
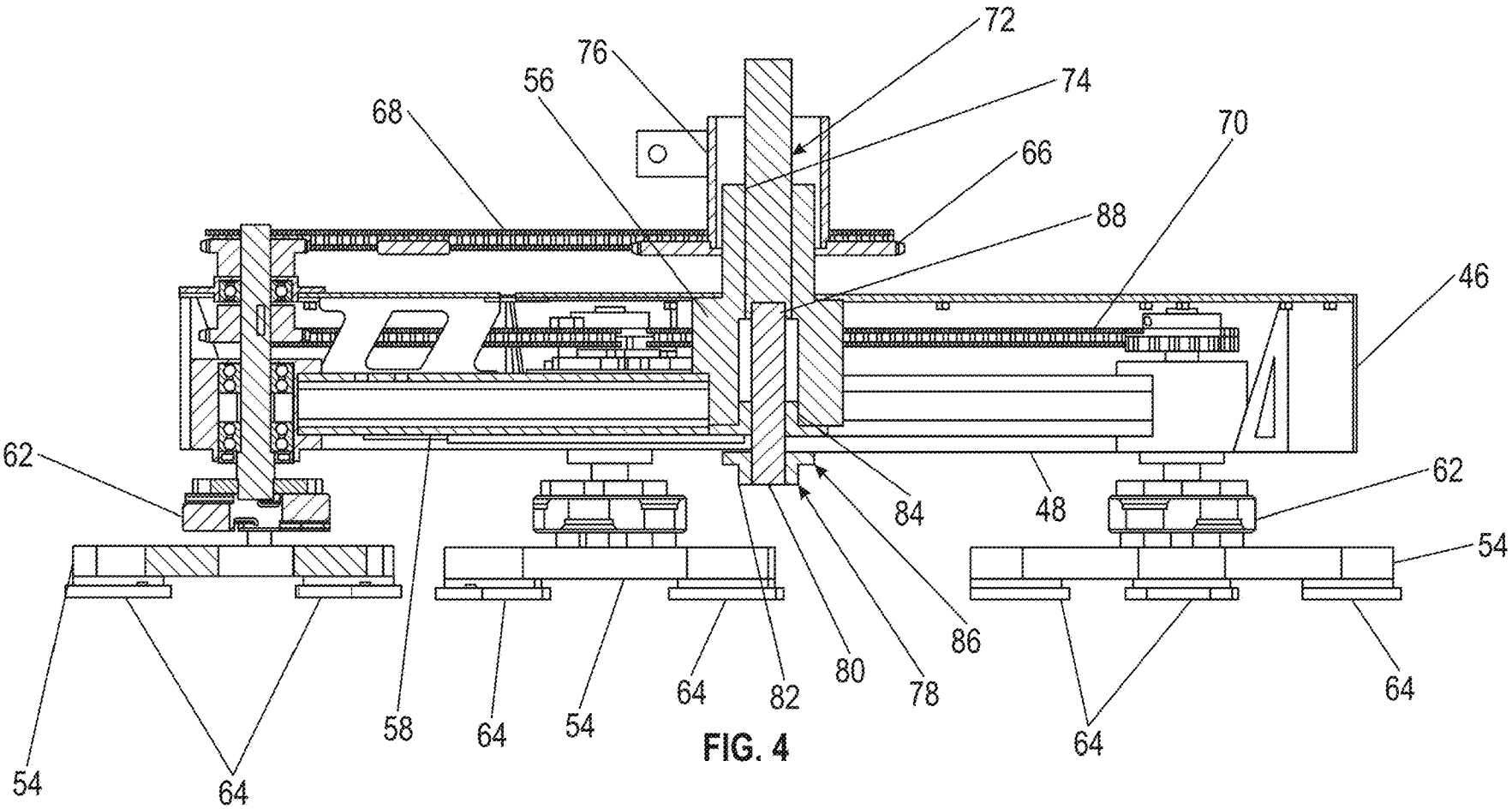
FIG. 4 illustrates a cross-sectional view of a planetary gearbox housing.

Referring now to FIG. 4, the drive shaft 72 is an output shaft of a gearbox that is coupled to an engine shaft. The rotation of the drum 46 is caused by keyed engagement of the drive shaft 72 with the center bore 74 in the internal body 56. Thus, the drive shaft 72 is cable of rotating the drum 46 relative to the bull gear 66, which is secured to the body of the grinder 10. The bull gear 66 includes a bull gear sleeve 76 the extends around at least a portion of the drive shaft 72 and is fastened to the body 12 of the grinder 10 so that the bull gear does not rotate about the axis of the sleeve 76 with respect to the body of the grinder 10.

The drive shaft 72 is seated on a stop bolt assembly 78. The stop bolt assembly 78 includes a threaded shaft 80, a first nut 82, and a second nut 84. The threaded shaft 80 extends through a hole 85 defined in the bottom wall 48. The first nut 82 is threaded on the shaft 80 below the bottom wall 48. The second nut is tightened on the threaded shaft 80 above the bottom wall 48. The two nuts are tightened so a seal of the hole 85 is formed at 86 by the first nut 82 and the bottom wall 48. When the two nuts 82, 84 are tightened, the shaft 80 is not vertically movable relative to the bottom wall 48. Thus, the upper end 88 of the shaft 80 provides a seat for the drive shaft 72. The upper end 88 of the shaft 80 extends into the lower end of the center bore 74, providing an at least partial seal of the lower end of the center bore.

Figure 5:
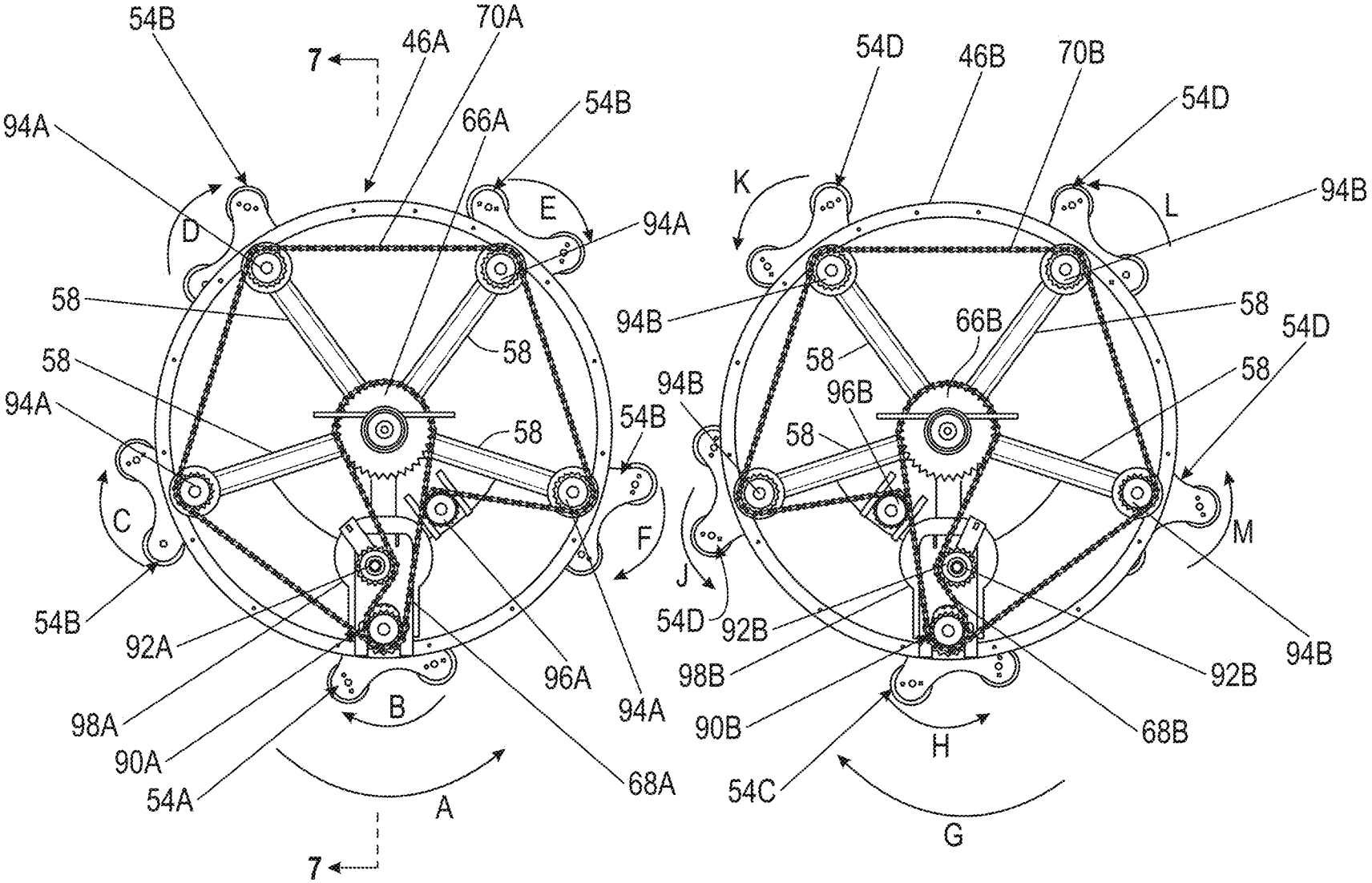
FIG. 5 illustrates a top view of two planetary gearbox housings.

FIG. 5 shows the counterrotation of two planetary gearboxes of the grinder 10 during operation. In the planetary gearbox on the left the first drive shaft causes the drum 46A to rotate counterclockwise along arrow A. The bull gear 66A is fixed to the body of the grinder 10. The bull gear 66A is connected by upper chain 68A to an upper sprocket 90A on the driven tooling assembly 54A. A tensioner 92A also engages the upper chain 68A to keep the chain in proper engagement with the upper sprocket 90A and to reduce the likelihood of failure of the upper chain 68A. As the driven tooling assembly 54A rotates with the drum, the upper chain 68A causes the shaft of the driven tooling assembly 54A to rotate clockwise about the axis of the shaft of the driven tooling assembly 54A along arrow B. The lower chain 70A engages a lower sprocket on the driven tooling assembly, lower sprocket 94A on each of the other tooling assemblies 54B, and a tensioner 96A. The clockwise rotation of the shaft of the driven tooling assembly 54A along arrow B is thus transmitted to the shafts of the other tooling assemblies 54B, as shown by arrow C, arrow D, arrow E, and arrow F.

In FIG. 5, the upper sprocket 90A is located above a bearing support mount 98A. The bearing support mount 98A may be fastened to the lids of the drum, to provide a sturdy platform for a bearing support beneath the upper sprocket 90A.

The rotational directions are opposite in the planetary gearbox on the right. In the planetary gearbox on the right the second drive shaft causes the drum 46B to rotate clockwise along arrow G. The bull gear 66B is fixed to the body of the grinder 10. The bull gear 66B is connected by upper chain 68B to an upper sprocket 90B on the driven tooling assembly 54C. A tensioner 92B also engages the upper chain 68B to keep the chain in proper engagement with the upper sprocket 90B and to reduce the likelihood of failure of the upper chain 68B. As the driven tooling assembly 54C rotates with the drum, the upper chain 68B causes the shaft of the driven tooling assembly 54C to rotate counterclockwise about the axis of the shaft of the driven tooling assembly 54C along arrow H. The lower chain 70B engages a lower sprocket on the driven tooling assembly, lower sprocket 94B on each of the other tooling assemblies 54D, and a tensioner 96B. The counterclockwise rotation of the shaft of the driven tooling assembly 54C along arrow H is thus transmitted to the shafts of the other tooling assemblies 54D, as shown by arrow J, arrow K, arrow L, and arrow M.

The upper sprocket 90B is located above a bearing support mount 98B. The bearing support mount 98B may be fastened to the lids of the drum, to provide a sturdy platform for a bearing support beneath the upper sprocket 90B.

Figure 6:
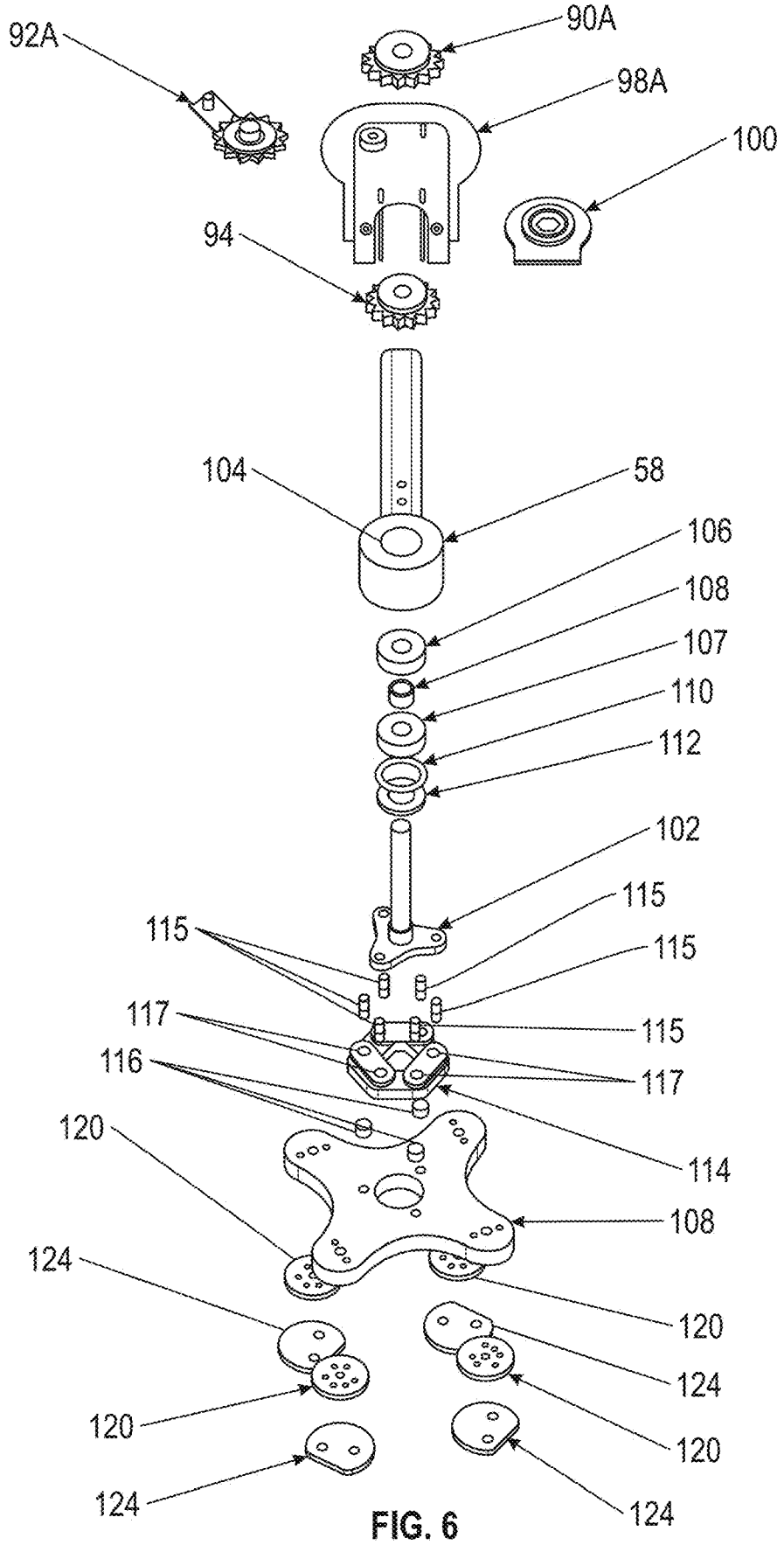
FIG. 6 illustrates an exploded view of a driven tooling assembly.
Figure 7:
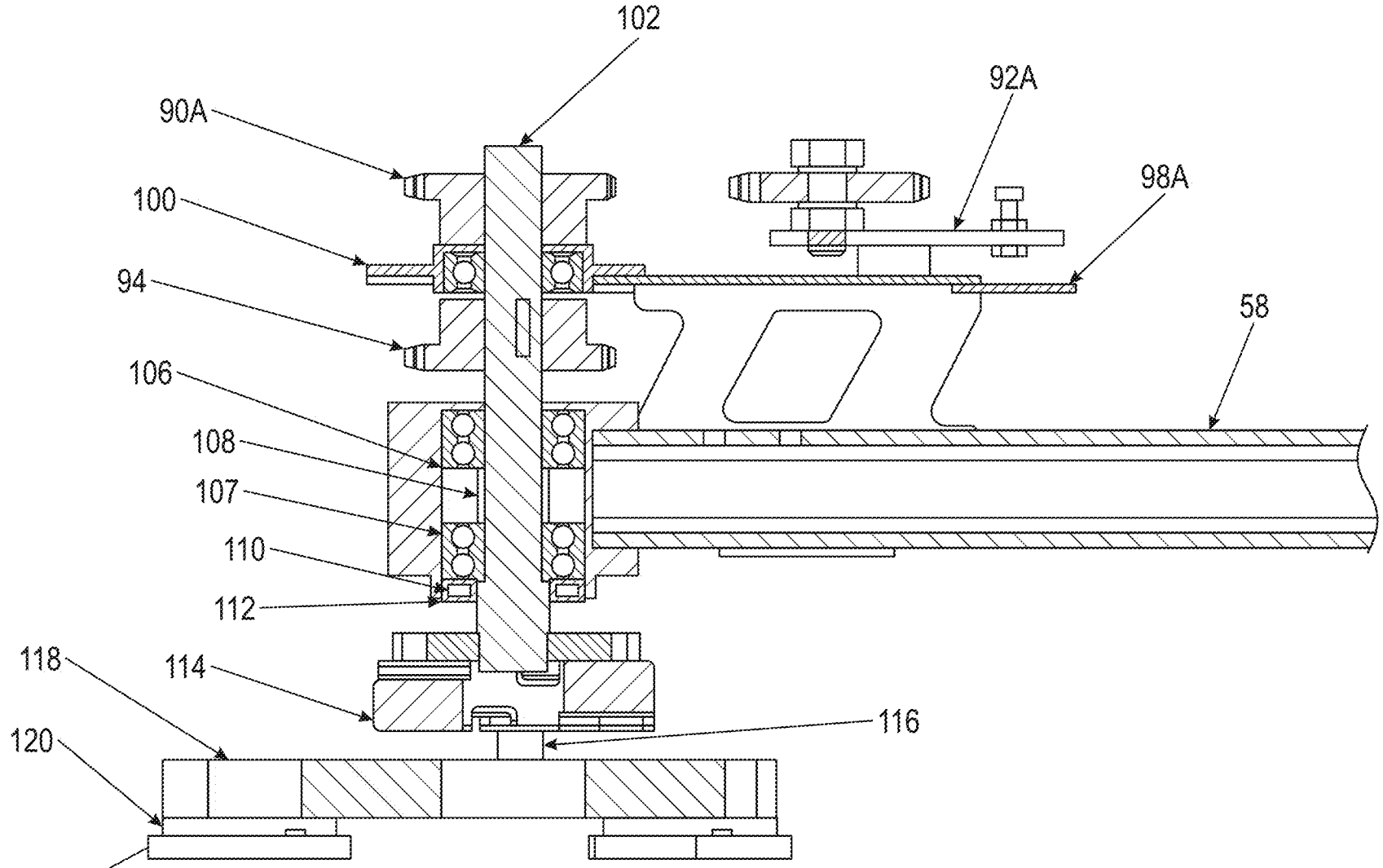
FIG. 7 illustrates a partial cross section of a planetary gearbox through a driven tooling assembly taken along a portion of section line 7-7 of FIG. 5.

FIG. 6 shows an exploded view of a driven tooling assembly, such as driven tooling assembly 54A in FIG. 5, along with tensioner 92A. FIG. 7 shows a partial cross section of a planetary gearbox with the driven tooling assembly in an assembled condition.

With reference to FIGS. 6 and 7, the upper sprocket 90A is located above the bearing support mount 98A. A bearing support 100 is seated on the bearing support mount 98A. The bearing support mount 98A may be fastened to the lids of the drum, to provide a sturdy platform for the bearing support 100. The bearing support 100 receives the shaft 102 of the driven tooling assembly and helps prevent bending of the shaft 102 in due to forces from the upper chain 68.

A lower sprocket 94 is located along the shaft below the upper sprocket 90A. The lower sprocket 94 is configured to engage the lower chain.

The shaft is received in a sleeve 104 defined in the arm 58. In particular, the sleeve 104 receives a bearing 106 a bearing spacer 108, a second bearing 107 a snap ring 110, and a seal 112 beneath the second bearing. The bearing 106, the bearing spacer 108, the second bearing 107, the snap ring 110, and the seal 112 are annular structures that extend around the shaft of the tooling assembly. The seal 112 is provided to prolong the life of the second bearing 107 by protecting the second bearing from particulates.

The lower end of the shaft is secured to a coupler 114. The coupler 114 is used to couple the shaft 102 to a driver plate 118, which can support tooling heads. The coupler 114 includes a plurality of sleeves 115 that are received in holes 117 defined in the body of the coupler 114. In the embodiment of FIG. 6, there are six sleeves 115 that are each received in a respective on of six holes 117 defined in the body of the coupler 114. The sleeves 115 help support the load of the device on the driver plate 118.

In some embodiments, the body of the coupler 114 is made of rubber and the sleeves 115 are made of metal. In some embodiments, the sleeves 115 may be made of steel.

Coupler spacers 116 connect the coupler 114 to a driver plate 118.

The driver 118 is configured to support four tool heads. Four magnetic holders 120 are secured to a lower surface of the driver plate 118. Four hook-and-loop holders 124 are secured to the magnetic holders 120. The hook-and-loop holders include a first side and a second side. The first side includes a metal plate that is magnetically attracted to the respective magnetic holder 120. The second side includes a hook-and-loop material that is adhered to the metal plate of the hook-and-loop holder 124. The hook-and-loop material is useful for supporting tool heads having a mating hook-and-loop backing.

Having thus described several aspects of at least one embodiment, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A planetary concrete grinder comprising:

a body;

at least one planetary gearbox rotatably secured to the body, each planetary gearbox having a center bore configured to receive drive shaft;

a bull gear rotationally fixed to the body;

a plurality of tooling assemblies attached to the planetary gearbox, each tooling assembly including a shaft; and a first sprocket along a length of the shaft;

a driven tooling assembly of the plurality of tooling assemblies further including a second sprocket along the length of the shaft of the driven tooling assembly;

a first driver that couples rotation of the bull gear with rotation of the second sprocket of the driven tooling assembly;

a second driver that engages the first sprocket of each of the tooling assemblies; and each planetary gearbox including a stop bolt secured within the center bore and below and abutting the drive shaft sealing the planetary gearbox.

2. The planetary concrete grinder of claim 1, wherein the driven tooling assembly further comprises a bearing support configured to be secured to a lid portion of the at least one respective planetary gearbox.

3. The planetary concrete grinder of claim 2, wherein the driven tooling assembly further comprises an upper shaft end bearing secured to the bearing support, the upper shaft end bearing being configured to receive the shaft of the driven tooling assembly and to seal the planetary gearbox.

4. The planetary concrete grinder of claim 1, wherein each tooling assembly further comprises a coupler secured to the shaft and configured to support a proportionate vertical load.

5. The planetary concrete grinder of claim 1, wherein the shaft of each tooling assembly is constructed from a high tensile strength material.

6. The planetary concrete grinder of claim 1, wherein each planetary gearbox further comprises a gearbox body including a plurality of arms, each tooling assembly being secured at a distal end of a respective one of the arms.

7. The planetary concrete grinder of claim 6, further comprising a receiver at the end of each of the arms configured to receive the shaft of a respective tooling assembly.

8. The planetary concrete grinder of claim 7, wherein the at least one bearing and the seal are secured within one of the receivers that is configured as a sleeve.

9. The planetary concrete grinder of claim 8, wherein the at least one bearing is two bearings received in the sleeve.

10. The planetary concrete grinder of claim 6, each tooling assembly further comprising at least one bearing along the length of the shaft; and a seal engaging a bottom surface of the at least one bearing.

11. The planetary concrete grinder of claim 1, wherein each planetary gearbox further comprises at least one tensioner engaging one of the first driver and the second driver.

12. The planetary concrete grinder of claim 1, wherein each tooling assembly supports at least one tool head.

13. The planetary concrete grinder of claim 12, wherein at least one of the tool heads comprises diamond abrasive.

14. The planetary concrete grinder of claim 1, wherein each planetary gearbox is positioned in a drum-shaped housing.

15. The planetary concrete grinder of claim 14, wherein the stop bolt seals a bottom portion of the housing.

* * * * *